US005831206A

United States Patent [19]

Cooper

[11] Patent Number: 5,831,206

[45] Date of Patent: Nov. 3, 1998

[54] RING VORTEX DEPTH CHARGE

[75] Inventor: Guy F. Cooper, Ventura, Calif.

[73] Assignee: The United States of America as represented by the Secretary of the Navy, Washington, D.C.

[21] Appl. No.: 903,215

[22] Filed: Jul. 2, 1997

[51] Int. Cl.[6] ..... F42B 19/01; F42B 10/00

[52] U.S. Cl. ..... 114/20.1; 102/476; 114/21.1

[58] Field of Search ..... 114/20.1, 20.2, 114/21.1, 23; 102/378, 390, 399, 409, 410, 411, 476; 89/1.11

[56] References Cited

U.S. PATENT DOCUMENTS

| | | | |
|---|---|---|---|
| 3,109,373 | 11/1963 | Saffer Jr. | 102/476 |
| 3,811,379 | 5/1974 | Sondheimer | 102/13 |
| 3,995,574 | 12/1976 | Drimmer | 114/20.1 |
| 4,188,884 | 2/1980 | White et al. | 114/20.1 |
| 4,337,703 | 7/1982 | Schoner | 102/306 |
| 5,078,069 | 1/1992 | August et al. | 114/20.1 |
| 5,247,887 | 9/1993 | Drimmer | 102/476 |

*Primary Examiner*—Charles Jordan
*Assistant Examiner*—Theresa M. Wesson
*Attorney, Agent, or Firm*—Melvin J. Sliwka; David S. Kalmbaugh

[57] ABSTRACT

Apparatus for generating a ring vortex which will damage the hull of the target vessel. The apparatus comprises a torpedo which is launched from an attack submarine in the direction of the target vessel. When the torpedo is at a predetermined position, the torpedo is detonated. Detonation of the torpedo results in the generation of a ring vortex. The ring vortex is directed toward the hull of the target vessel and will impact the hull of the target vessel with sufficient force to destroy or disable the target vessel. Positioned about the periphery of the torpedo are a plurality of necklace charges. The torpedo also has a central charge which is located near the front end of the torpedo. When detonated each necklace charge forms a ring of imploding gas bubbles which collapse inward. At a predetermined time period after the necklace charges are denoted, the main charge within the torpedo is denoted resulting in the generation of an expanding gas bubble which expands outwardly. The detonation of the necklace charges followed by the detonation of the main charge results in a region of counterflow which causes a substantially circular circulation pattern for the ring vortex.

20 Claims, 5 Drawing Sheets

RING VORTEX DEPTH CHARGE

BACKGROUND OF THE INVENTION

1. Field of the Invention

The present invention relates generally to depth charges which may be used to disable or destroy a target at sea. More specifically, the present invention relates to a depth charge comprising a ring vortex which is generated underwater by a torpedo fired from a submarine and which is used to disable or destroy a target such a ship or another submarine.

2. Description of the Prior Art

Submarine weapons for the combating of submarines, ships and other ocean going targets are known as torpedoes which, upon entering the water, will locate a target submarine or ship by means of an acoustic target seeking device. The torpedo is then steered toward the target submarine or ship by means of a steering unit evaluating ranging results from the target (homing). The torpedoes are usually equipped with a relatively low-noise propeller drive unit in order to prevent impairment of the function of the acoustic target seeking device by too high of an intrinsic noise level. The propeller in the torpedo is driven by a gas turbine, an internal combustion engine, or an electric motor.

Another submarine weapon for antisubmarine and target ship use consists of a torpedo of the MK 46 type, a rocket engine, and a parachute. This system is airborne, i.e. it is fired in each case from a surface vessel or an aircraft. Upon entrance into the water, the torpedo separates from the other parts of the system and is caused to home after target detection.

Propeller driven torpedoes have the draw back of having mechanically very sophisticated drive mechanisms which result in a great deal of expenditure. In case the propeller is driven electrically, a considerable portion of the volume and weight of the torpedo is taken by the batteries. Additionally, such torpedoes are not exempt from servicing over a prolonged period of time; rather, the torpedoes must be operated at regular intervals to ensure their functioning.

A submarine weapon of the type heretofore described has been known which is transported into the proximity of the target by means of a rocket engine through the air from a mother ship. Upon entrance into the water, the rocket chamber serves as the operating chamber of a hydraulic pulsed engine which allows the weapon to be driven underwater. The hydraulic pulsed engine operates by repeatedly filling the rocket chamber with water which is then ejected at high velocity through a nozzle at the rear of the weapon body by means of a number of gas pressure generators ignited in succession. During the burning of one of the gas generators and the subsequent ejection of water from the rocket chamber in order to accelerate the torpedo weapon, a considerable intrinsic noise is produced. However, between the drive impulses, the inherent noise of the hydraulic pulsed drive mechanism is at a minimum so that the acoustic sensors of the target locating device are capable of listening for noises of a submarine or target ship in the surroundings of the torpedo weapon. The interval operation of hydraulic pulsed motor and acoustic target seeking device, though, represents a compromise that is not close to an optimum; on the one hand, the torpedo weapon cannot attain any high traveling velocities and, on the other hand, the effectiveness and accuracy of the acoustic target locating device is limited with regard to its ranging zone.

Torpedoes currently in use have several other limitations which severely limit their effectiveness and accuracy. For example, torpedoes have a finite speed, which for the successful intercept of a moving target requires an extremely accurate lead angle and substantial maneuvering agility of the torpedo. In addition, torpedoes are limited in their range since the torpedo is generally dependent on stored fuel and is susceptible to drag caused by ocean currents. The acoustic signature of the torpedo is also very detectable permitting early detection and evasive maneuvering or even interception by an anti-torpedo weapon.

SUMMARY OF THE INVENTION

The invention is based on the object of providing a submarine weapon of the type discussed hereinabove which exhibits an economical, effective and, above all, a target seeking apparatus having an ability to effectively disable a target vessel such a ship by providing a ring vortex of sufficient strength to severely damage the hull of the target vessel.

When an attack submarine engages a target vessel, the attack submarine launches a torpedo in the direction of the target vessel. When the torpedo is at a predetermined position, the torpedo is detonated. Detonation of the torpedo results in the generation of a ring vortex. The ring vortex is directed toward the hull of the target vessel and will impact the hull of the target vessel with sufficient force to either destroy the target vessel or severely disable the target vessel.

The torpedo has positioned about its periphery a plurality of satellite or necklace charges. The torpedo also has a main or central charge therein which is located near the front end of the torpedo. When detonated each necklace charge forms a ring of imploding gas bubbles which collapse inward. The radius of the ring of imploding gas bubbles is $R_n$ from the center of the torpedo and may be within a range of 10 feet to 30 feet.

At a predetermined time period after the necklace charges are denoted, the main charge within the torpedo is denoted resulting in the generation of an expanding gas bubble which expands outwardly. The time period between denotation of the necklace charges and the main charge within the torpedo is generally between 10 and 20 milliseconds. The detonation of the necklace charges followed by the detonation of the main charges result in a region of counterflow which causes a substantially circular circulation pattern for the ring vortex.

DETAILED DESCRIPTION OF THE PREFERRED EMBODIMENT

Figure 1:
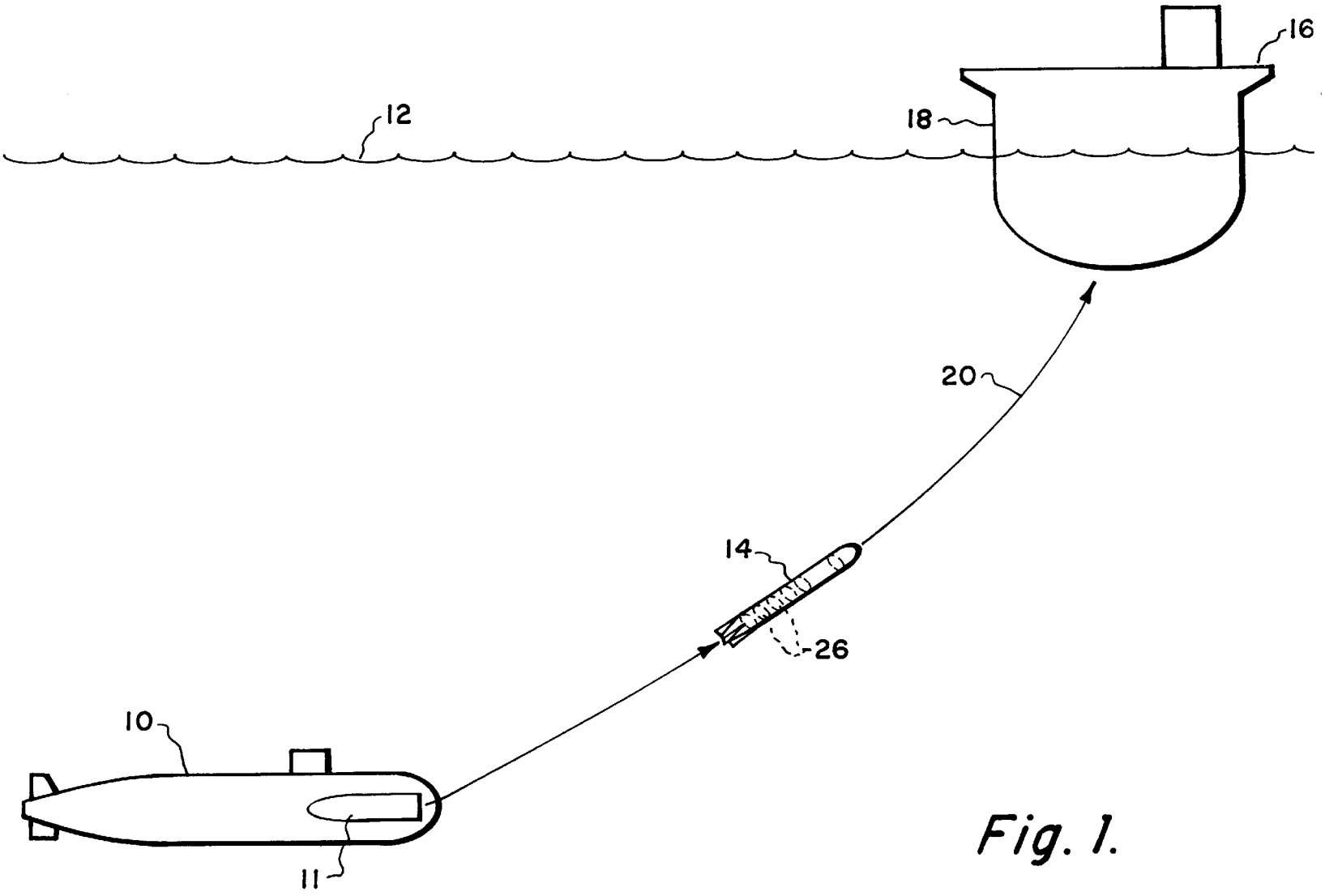
FIG. 1 illustrates an attack submarine launching a torpedo having a ring vortex depth charge which is used to disable a target vessel.
Figure 2B:
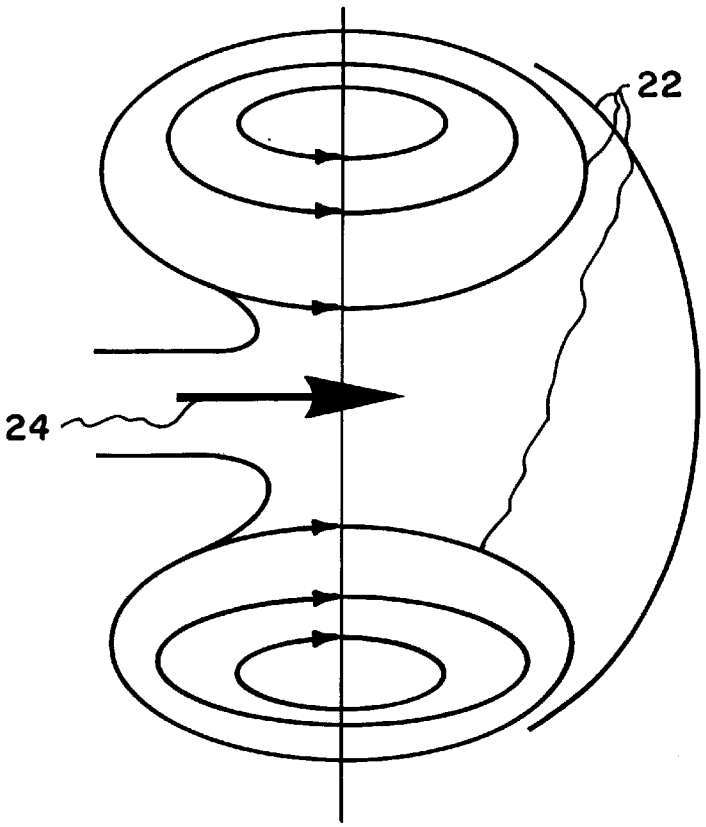
FIGS. 2A and 2B illustrate the formation of a ring vortex from the ring vortex depth charge of FIG. 1.
Figure 2A:
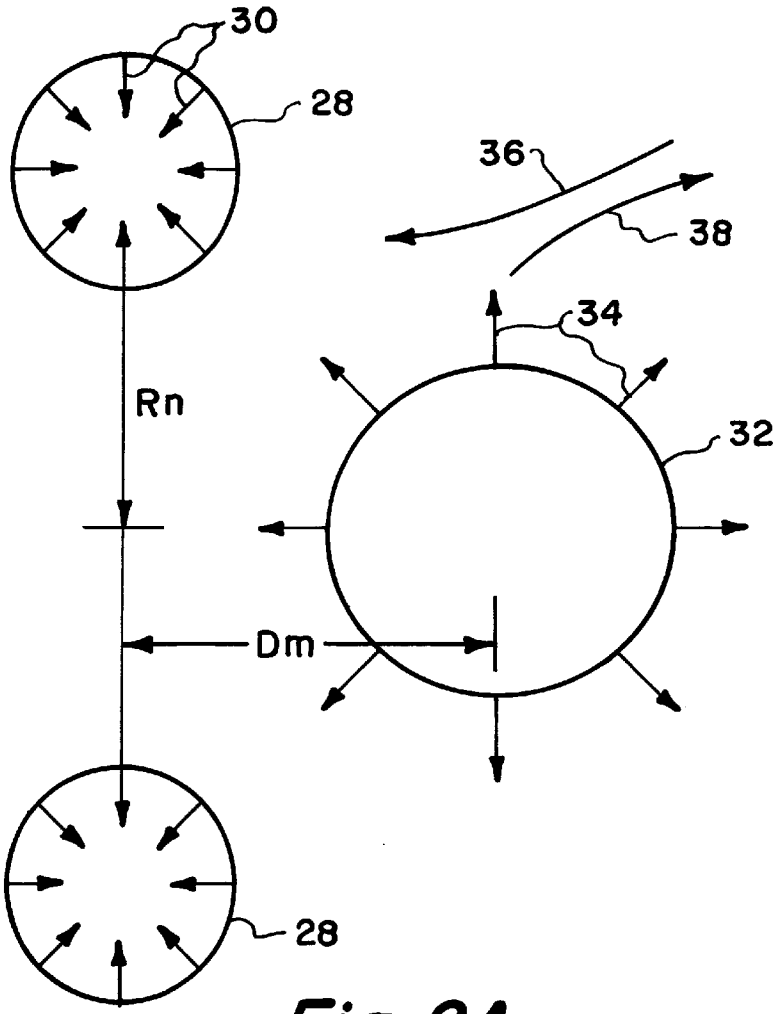

Referring to FIGS. 1, 2A and 2B, there is shown an attack submarine 10 which has at least a pair of torpedo launching tubes 11 positioned at the front end of attack submarine 10.

A target vessel 16 which is on the ocean's surface 12 is being tracked by attack submarine 10. The target vessel 16 may be, for example, an aircraft carrier, a cargo ship, a destroyer or a battleship which the attack submarine 10 is seeking to disable or destroy. In addition, the target vessel 16 may be another submerged submarine (not illustrated) which attack submarine 12 is tracking.

Upon engaging target vessel 16, attack submarine 10 launches a torpedo 14 in the direction indicating by arrow 20 toward target vessel 16. When torpedo 14 is at a predetermined position, which is generally within range of target vessel 16, torpedo 14 is detonated. Detonation of torpedo 14 results in the generation of a ring vortex 22 which has a forward direction indicated by arrow 24. Ring vortex 22 is directed toward the hull 18 of target vessel 16 and will impact hull 18 of target vessel 16 with sufficient force to either destroy target vessel 16 or disable target vessel 16 limiting the target vessel's effectiveness.

Deployed from the periphery of torpedo 14 are a plurality of necklace charges 26. Prior to deployment, the necklace charges 26 are located about the periphery of torpedo 14. Torpedo 14 also has a main or central charge therein which is located near the front end of torpedo 14. When detonated each necklace charge 26 forms a ring of exploding and then imploding gas bubbles 28 which collapse inward as is best indicated by arrows 30. The radius of the each ring of imploding gas bubbles 28 is $R_n$ and the ring may have eight or more gas bubbles 28, two of which are illustrated in FIG. 2A.

At a predetermined time period after the necklace charges are denoted, the main charge within torpedo 14 is denoted resulting in the generation of an expanding gas bubble 32 which expands outwardly as is best indicated by arrows 34. The distance between the plane of the ring of imploding gas bubbles 28 and the center of expanding gas bubble 32 is $D_m$, while the time period between denotation of the necklace charges 26 and the main charge within torpedo 14 is between 10 and 20 milliseconds. Arrows 36 and 38 indicate a region of shearing counterflow which is caused by the collapse of the gas bubbles 28 from the detonation of necklace charges 26 and the expansion of the gas bubble 32 from the detonation of the main charge within torpedo 14 resulting in the circulation pattern for ring vortex 22 illustrated in FIG. 2B.

The distance $D_m$ to the ring of imploding gas bubbles and the radius $R_n$ of the ring of imploding gas bubbles 28 will determine the momentum and, thus, the impact of ring vortex 22 on the hull 18 of target 16 which allows ring vortex 22 to disable target 16. The orientation of the plane of the necklace charges 26 as well as $D_m$ and $R_n$ are used to determine the velocity and direction of ring vortex 22 to target 16 to insure that ring vortex 22 intercepts target 22. The distance $D_m$ is generally between five feet and twenty feet, while the radius $R_n$ is generally between ten feet and thirty feet.

At this time it should be noted that gas bubble 32 may be in positioned in front of gas bubbles 28 as depicted in FIG. 2A or gas bubble 32 may be positioned behind gas bubble 28. It should also be noted that the detonation of necklace charges 26 occurs prior to the detonation of the main charge within torpedo 14.

Figure 3B:
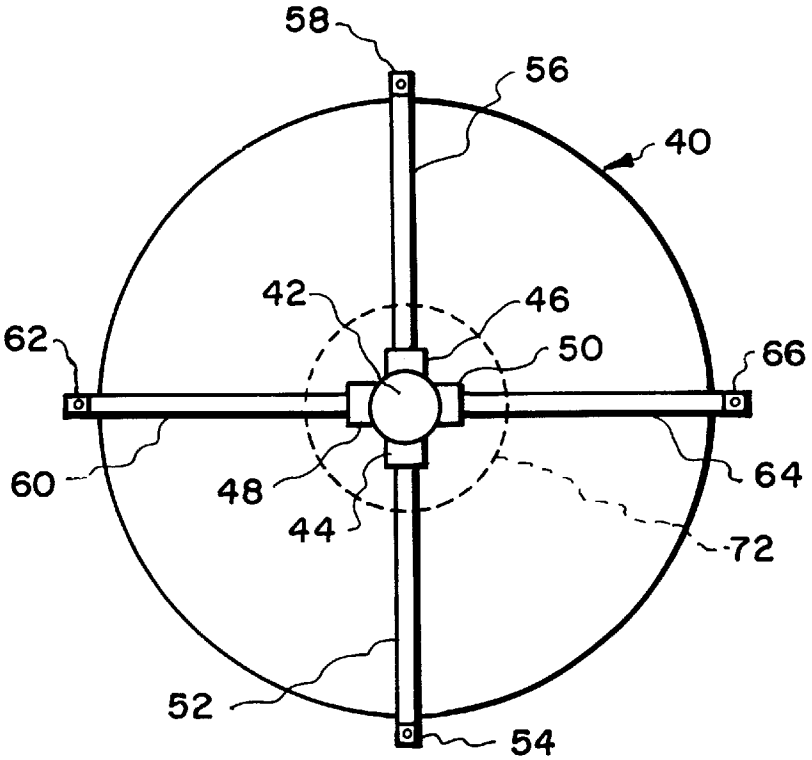
FIGS. 3A and 3B illustrate the structure of each spherical necklace charge element of the necklace charges of FIG. 1.
Figure 3A:
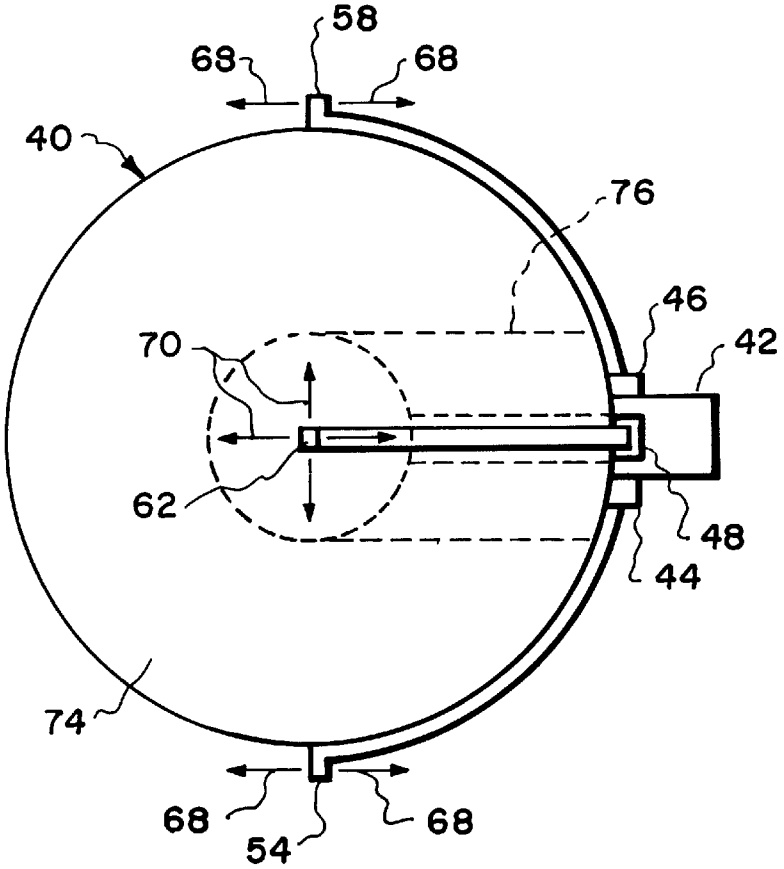

Referring to FIGS. 1, 2A, 2B, 3A and 3B, there is shown in FIGS. 3A and 3B one of the plurality of spherical charge elements 40 of the necklace charges 26 illustrated in FIG. 1. Each spherical charge element 40 has a propulsion system 124 (FIG. 5) mounted on its outer surface. The propulsion system 124 for each charge element 40 includes a seawater intake pump 42 and four selector valves 44, 46, 48 and 50 which are connected to the discharge of seawater intake pump 42. As is best illustrated in FIG. 3B each of the selector valves 44, 46, 48 and 50 are offset by ninety degrees from their adjacent selector valves.

Connected to selector valve 44 is one end of a jet feed pipe 52 which has a two direction steering nozzle 54 connected to its opposite end. In a like manner, one end of a jet feed pipe 56 is connected to selector valve 46, while the opposite end of jet feed pipe 56 is connected to a two direction steering nozzle 58.

Connected to selector valve 48 is one end of a jet feed pipe 60 which has a four direction steering nozzle 62 connected to its opposite end. Similarly, one end of a jet feed pipe 64 is connected to selector valve 50, while the opposite end of jet feed pipe 64 is connected to a four direction steering valve 66.

Nozzles 54, 58, 62 and 66 are mounted on the outer surface of spherical charge element 40 around the circumference of element 40. As shown in FIG. 3B, nozzles 54, 58, 62 and 66 are positioned about the circumference of element 40 about ninety degrees from their adjacent nozzles. Two direction steering nozzles 54 and 58 are perpendicular to four direction steering nozzles 62 and 66 as depicted in FIG. 3B.

When activated two direction steering nozzles 54 and 58 eject seawater under pressure in one of the two directions indicated by arrows 68. When activated four direction steering nozzles 62 and 66 eject water under pressure in at least one of the four directions indicated by arrows 70. The combination of two direction steering nozzles 54 and 58 and four direction steering nozzles 62 and 66 provide directional movement for spherical charge element 40 which may have rectilinear movement or rotational movement required for the deployment of charge element 40.

Figure 5:
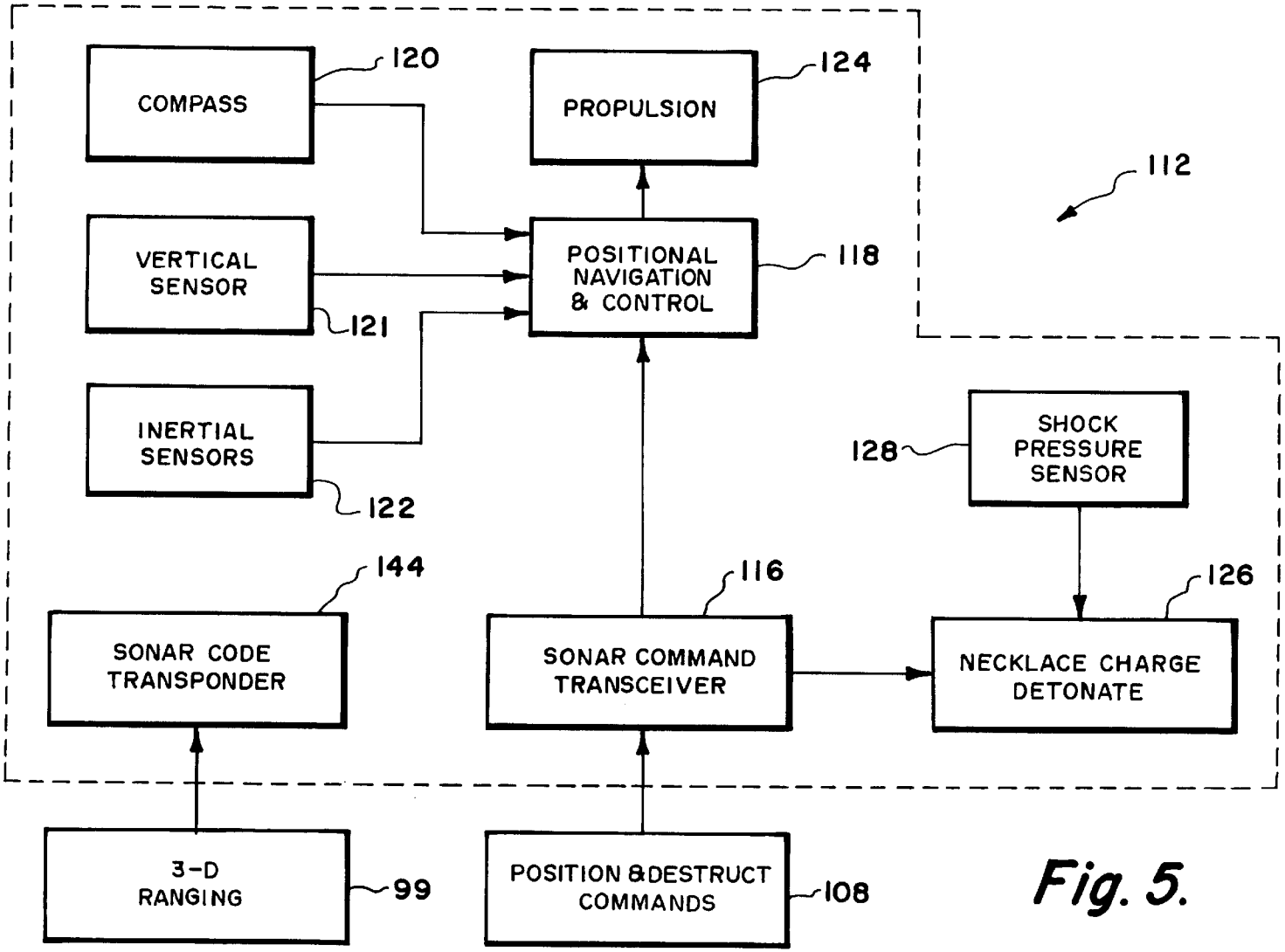
FIG. 5 illustrates an electrical block diagram of the electrical components mounted within each spherical necklace charge element of the necklace charges of FIG. 1.

Spherical charge element 40 has a core 72 which contains the electrical components of FIG. 5 which deploy charge element 40 and then detonate charge element 40. Core 72 also provides for neutral buoyancy of spherical charge element 40.

The explosive material or charge 74 for charge element 40 is located within charge element 40 between the core 72 of charge element 40 and the surface of charge element 40. Spherical charge element 40 also has an explosive plug 76 which may be removed from charge element 40 to allow access to the core 72 of element 40. Explosive plug 76 is fabricated from explosive material 74 to maintain spherical symmetry of the explosion when element 40 is detonated.

When each of the spherical charge elements 40 is deployed and then detonated it generates one of the ring of collapsing gas bubbles 28 of FIG. 2A.

The velocity U for the ring vortex 22 is expressed by the following equation:

$$U = \left(\frac{K}{2\pi r}\right)\left(\log\left(\frac{8r}{\sqrt{4\nu t}}\right) - 0.0558 + O\sqrt{\frac{\nu t}{r^2}}\right) \quad (1)$$

where:

K=circulation around the thin core of the ring vortex r=radius of the ring

υ=the kinematic velocity of the fluid t=time

O=order of magnitude

The impulse I for the ring is assumed constant and is approximated by the following equation:

$$I=\rho\pi r^2 K \quad (2)$$

where:

ρ=density

To illustrate equation 1, above, a ring vortex 22, FIG. 3B, which has a radius of 6 inches, a circulation of 800 feet squared per second and a kinematic viscosity of 0.00001233 feet squared per second in seawater will have an initial velocity of 765 feet per second.

To further illustrate the impact of a ring vortex 22 on the hull 18 of target vessel 16, a forty foot diameter ring vortex will have an initial bulk velocity of 88 feet per second and an initial over pressure of 7,740 pounds per foot squared. At a range of forty feet, the ring vortex will have a velocity of 55 feet per second and an over pressure of 4,055 pounds per foot squared. At a range of 250 feet, the ring vortex will have a velocity of 4 feet per second and an over pressure of 812 pounds per foot squared.

Figure 4:
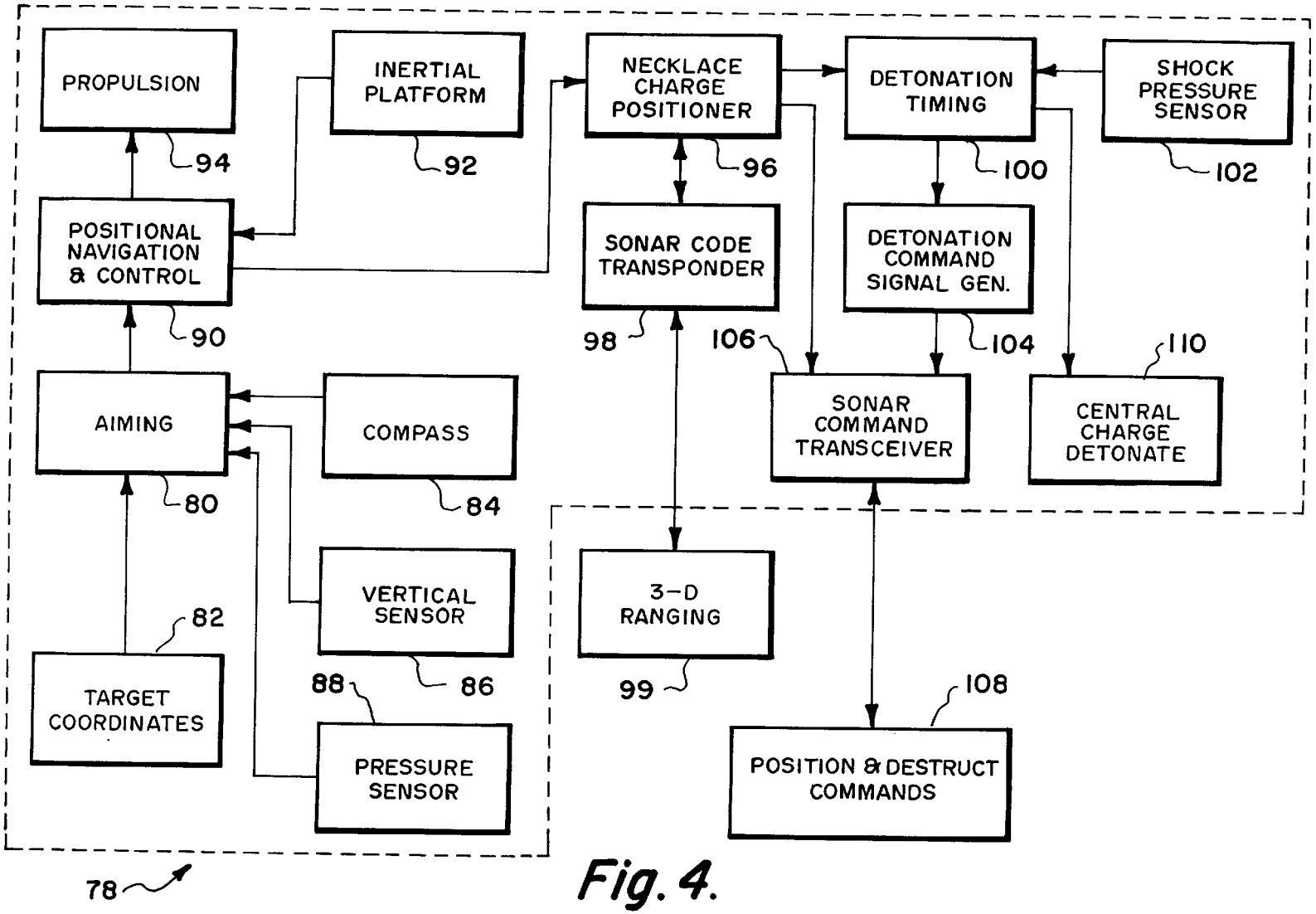
FIG. 4 illustrates an electrical block diagram of the electrical system mounted within the torpedo of FIG. 1 which controls the deployment, positioning and detonation of the necklace charges of the ring vortex depth charge.

Referring now to FIGS. 1, 2A, 2B, 3A, 3B and 4, there is shown in FIG. 4 an electrical block diagram of the electrical system 78 mounted within the torpedo 14 of FIG. 1 which controls the deployment and positioning of torpedo 14 and the detonation of the main charge within torpedo 14. Electrical system 78 includes an aiming circuit 80 with a guidance system for directing the torpedo 14 toward target vessel 16 to acquire target vessel 14 prior to the deployment of necklace charges 26 and their detonation and the detonation of the main charge within torpedo 14. Electrical system 78 has connected thereto a target coordinates circuit 82 for providing positional data as to the location of target vessel 16 to torpedo 14. The positional data may, for example, be azimuth and elevation coordinates for target vessel 16 or it may be x,y,z coordinates relative to torpedo 14 for the target vessel 16.

There is also connected to aiming circuit 80 a compass 84 which provides a directional reference for aiming circuit 80 with respect to magnetic north; a vertical sensor 86 which provides an electrical signal indicating depth of torpedo 14 and a pressure sensor 88 which provides an electrical signal indicating the water pressure exerted on torpedo 14.

Aiming circuit 80 is connected to a positional navigation and control computer 90 which includes electronics for steering the propulsion system 94 of the torpedo 26 toward target vessel 14 prior to detonation of the main charge within torpedo 14 and necklace charges 26 which form the ring vortex 22 of FIG. 2B. There is also connected to positional navigation and control computer 90 an inertial platform 92. Inertial platform 92 includes a vertical rate gyro which provides pitch rate data to positional navigation and control computer 90 and an accelerometer for measuring acceleration components of torpedo 14.

Positional navigation and control computer 90 is connected to a necklace charge positioner computer 96. Positional navigation and control computer 90 provides positional data to necklace charge positioner computer 96 which then provides steering and positioning command signals 108 to the propulsion system 124 (FIG. 5) for the spherical charge elements 40 of necklace charges 26. The steering and positioning command signals 108 for the charge elements 40 of necklace charges 26 are supplied via a sonar transceiver 106 to a sonar transceiver 116 (FIG. 5).

The steering and positioning command signals 108 provided to positional and navigation control computer 118 (FIG. 5) activate and control the selector valves 44, 46, 48 and 50 and their associated steering nozzles 54, 58, 62 and 66 of the propulsion system 124 (FIG. 5) of each spherical charge element 40 to position each charge element 40 at the radius $R_n$ from the center of torpedo 14.

The necklace charge positioner computer 96 on board torpedo 14 is also connected to a detonation timing circuit 100 which provides timing detonation signals for detonating the main charge and the necklace charges to a detonation command signal generator 104 and a central charge detonate circuit 110. Central charge detonate circuit 110 responsive to these timing detonation signals detonates the main charge within torpedo 14 approximately 20 milliseconds after the necklace charges 26 are detonated. There is also connected to detonation timing circuit 100 a shock pressure sensor 102 which responds to shock pressure exerted on torpedo 14 to detonate the main charge within torpedo 14 in the event detonation timing circuit 100 fails to detonate the main charge.

The detonation command signal generator 104 responsive to the timing signals from circuit 100 generates detonation or destruct command signals 108 for each spherical charge element 40 of necklace charges 26. These destruct commands are also supplied via transceiver 106 to transceiver 116 (FIG. 5) of each spherical charge element 40.

Electrical system 78 also has a master sonar code transponder 98 for transmitting and receiving 3-D ranging data 99 which identifies the present location of each spherical charge element 40 of the plurality of necklace charges 26. Each spherical charge element 40 of each necklace charge 26 has an individual eight bit digital code assigned thereto so that position and destruct commands for any one of the charge elements 40 are received and processed only by the one charge element 40 identified by the eight bit digital code. There is also located on board each charge element 40 a slave sonar code transponder 144 (FIG. 5) which in combination with master code transmitter 98 provides location data to necklace charge positioner computer 96 which indicates the present location of each charge element 40 of the plurality of necklace charges 26. This position data allows necklace charge positioner computer 96 to generate the steering and positional commands for each spherical charge element 40 so that each charge element 40 is positioned to form a ring prior to detonation having the radius $R_n$ from the center of torpedo 14.

Referring now to FIGS. 1, 2A, 2B, 3A, 3B and 5, there is shown in FIG. 5 an electrical block diagram of the electrical system 112 mounted within the core 72 of each charge element 40 which controls the deployment and positioning of charge element 40 and the detonation of the charge element 40.

The sonar command transceiver 116 on board each spherical charge element 40 receives the steering, positional and destruct commands for the charge element 40 with the element 40 being identified by its associated eight bit digital code. These steering and positional commands are provided to a positional navigation control computer 118, while the destruct command is supplied to a necklace charge detonate circuit 126.

Connected to positional navigation control computer 118 is a compass 120 which provides a directional reference for charge element 40 with respect to magnetic north; a vertical sensor 121 which provides an electrical signal indicating depth of charge element 40 and a plurality of inertial sensors 122 which provide electrical signals indicating external forces acting upon charge element 40 which may have an effect upon the movement and location of charge element 40.

Positional navigation and control computer 118 is connected to the propulsion system 124. Positional navigation and control computer 118, in response to the steering and positional command signals 108, steers the charge elements 40 of the necklace charge 26 positioning each charge element 40 of the necklace charge 26 to form a ring of charge elements 40 of radius $R_n$ from the center of torpedo 14.

Necklace charge detonate circuit 126 in response to the destruct command signal 108 detonates the charge element 40 approximately 20 milliseconds prior to the main charge within torpedo 14 being detonated.

It should be noted that a shock pressure sensor 128 is connected to necklace charge detonate circuit 126. Necklace charge detonate circuit 126 responds to shock pressure exerted on spherical charge element 40 serving as a backup system for detonating the charge elements 40 of necklace charges 26. Necklace charge detonate circuit 126 also insures simultaneous detonation of the charge elements 40 of the necklace charges 26.

From the foregoing, it may readily be seen that the present invention comprises a new, unique and exceedingly useful ring vortex for disabling a ship or the like which constitutes a considerable improvement over the known prior art. Obviously many modifications and variations of the present invention are possible in light of the above teachings. It is therefore to be understood that within the scope of the appended claims that the invention may be practiced otherwise than as specifically described.

What is claimed is:

1. A weapon launched from a launching tube of a submarine for destroying a seawater target vessel comprising:

a torpedo launched from the launching tube of said submarine toward said seawater target vessel;

a main charge located within said torpedo near the front end of said torpedo;

a necklace charge positioned about the periphery of said torpedo, said necklace charge having a plurality of spherical charge elements which are equally spaced about the periphery of said torpedo, said plurality of spherical charge elements being deployed from said torpedo at a predetermined radius from said torpedo;

each of said spherical charge elements including steering means for steering said spherical charge element underwater and positioning said spherical charge elements at said predetermined radius from said torpedo in response to steering and positioning command signals, an explosive charge positioned within said spherical charge element and charge element detonation circuit means for detonating said explosive charge in response to a first detonation signal;

command signal generating means mounted within said torpedo for providing said steering and positioning command signals;

said command signal generating means providing said first detonation signal to said charge element detonation circuit means for each of said spherical charge elements for simultaneously detonating the explosive charge within each of said spherical charge elements to form a ring of imploding gas bubbles;

said command signal generating means providing a second detonation signal; and main charge detonation circuit means, responsive to said second detonation signal, detonating said main charge to form an expanding gas bubble, said main charge detonation circuit means detonating said main charge after said torpedo travels a predetermined distance from a position where said spherical charge elements of said necklace charge are detonated;

said imploding gas bubbles and said expanding gas bubble forming a ring vortex, said ring vortex being directed to said seawater target vessel, said ring vortex impacting said seawater target vessel to destroy said seawater target vessel.

2. The weapon of claim 1 wherein said plurality of spherical charge elements comprises at least eight spherical charge elements.

3. The weapon of claim 1 wherein said predetermined radius said plurality of spherical charge elements are deployed from said torpedo is within a range of about ten feet to about thirty feet.

4. The weapon of claim 1 wherein said predetermined distance said torpedo travels from said position where said spherical charge elements are detonated is within a range of about five feet to about thirty feet.

5. The weapon of claim 1 wherein said steering means for each of said spherical charge elements of said necklace charge comprises:

a seawater pump have an inlet port and a discharge port, said seawater pump being mounted on an outer surface of said spherical charge element;

first, second, third and fourth selector valves mounted on the outer surface of said spherical charge element, each of first, second, third and fourth selector valves being offset by ninety degrees from an adjacent one of said first, second, third and fourth selector valves, each of said selector valves being connected to the discharge port of said seawater pump;

first, second, third and fourth jet feed pipes, said first jet feed pipe having one end thereof connected to said first selector valve, said second jet feed pipe having one end thereof connected to said second selector valve, said third jet feed pipe having one end thereof connected to said third selector valve and said fourth jet feed pipe having one end thereof connected to said fourth selector valve; and first, second, third and fourth direction steering nozzles mounted on the outer surface of said spherical charge element, said first direction steering nozzle being connected to an opposite end of said first jet feed pipe, said second direction steering nozzle being connected to an opposite end of said second jet feed pipe, said third direction steering nozzle being connected to an opposite end of said third jet feed pipe and said fourth direction steering nozzle being connected to an opposite end of said fourth jet feed pipe.

6. The weapon of claim 5 wherein said first and third direction steering nozzles are two direction steering nozzles.

7. The weapon of claim 5 wherein said second and fourth direction steering nozzles are four direction steering nozzles.

8. The weapon of claim 5 wherein said steering means further comprises:

a sonar transceiver having an output port;

a positional and navigation control computer having an output port connected to said first, second, third and fourth selector valves and said first second third and fourth direction steering nozzles, said positional and navigation control computer having a first input port connected to the output port of said sonar transceiver, a second input port, a third input port and a fourth input port;

a compass having an output port connected to the second input port of said positional and navigation control computer;

a vertical sensor having an output port connected to the third input port of said positional and navigation control computer; and a pressure sensor having an output port connected to the fourth input port of said positional and navigation control computer.

9. The weapon of claim 1 wherein said command signal generating means comprises:

an aiming circuit having an output port;

a positional navigation and control computer having an input port connected to the output port of said aiming circuit and an output port;

a necklace charge positioner computer having an input port connected to the output port of said positional navigation and control computer, a first output port and a second output port;

a detonation timing circuit having an input port connected to the first output port of said necklace charge positioner computer, a first output port connected to said main charge detonation circuit means and a second output port;

a detonation command signal generator having an input port connected to the second output port of said detonation timing circuit and an output port; and a sonar transceiver having a first input port connected to the second output port of said necklace charge positioner computer and a second input port connected to the output port of said detonation command signal generator.

10. The weapon of claim 9 wherein said command signal generating means further comprises:

a target coordinates circuit having an output port connected to a first input port of said aiming circuit;

a compass having an output port connected to a second input port of said aiming circuit;

a vertical sensor having an output port connected to a third input port of said aiming circuit; and a pressure sensor having an output port connected to a fourth input port of said aiming circuit.

11. The weapon of claim 1 wherein said charge element detonation circuit means comprises a sonar transceiver having a first output port and a necklace charge detonate circuit having an input port connected to the output port of said sonar transceiver.

12. A weapon launched from a launching tube of a submarine for destroying a seawater target vessel comprising:

a torpedo launched from the launching tube of said submarine toward said seawater target vessel;

a main charge located within said torpedo near the front end of said torpedo;

a necklace charge positioned about the periphery of said torpedo, said necklace charge having a plurality of spherical charge elements which are equally spaced about the periphery of said torpedo, said plurality of spherical charge elements being deployed from said torpedo at a predetermined radius from said torpedo;

each of said spherical charge elements including a propulsion system mounted on an outer surface of said spherical charge element for steering said spherical charge element underwater and positioning said spherical charge elements at said predetermined radius from said torpedo in response to steering and positioning command signals, an explosive charge positioned within said spherical charge element and a charge element detonation circuit connected to said explosive charge for detonating said explosive charge in response to a first detonation signal;

a command signal generating circuit mounted within said torpedo for providing said steering and positioning command signals, said command signal generating circuit generating said first detonation signal and a second detonation signal;

said command signal generating circuit including a command sonar transceiver;

said charge element detonation circuit for each of said spherical charge elements including a slave sonar transceiver;

the command sonar transceiver of said command signal generating circuit providing said first detonation signal to the slave sonar transceiver of said charge element detonation circuit for each of said spherical charge elements to simultaneously detonate the explosive charge within each of said spherical charge element to form a ring of imploding gas bubbles; and a main charge detonation circuit connected to said command signal generating circuit and said main charge;

said main charge detonation circuit, responsive to said second detonation signal, detonating said main charge to form an expanding gas bubble, said main charge detonation circuit detonating said main charge after said torpedo travels a predetermined distance from a position where said spherical charge elements of said necklace charge are detonated;

said imploding gas bubbles and said expanding gas bubble forming a ring vortex, said ring vortex being directed to said seawater target vessel, said ring vortex impacting said seawater target vessel to destroy said seawater target vessel;

said propulsion system for each of said spherical charge elements of said necklace charge comprising:

a seawater pump have an inlet port and a discharge port, said seawater pump being mounted on an outer surface of said spherical charge element;

first, second, third and fourth selector valves mounted on the outer surface of said spherical charge element, each of first, second, third and fourth selector valves being offset by ninety degrees from an adjacent one of said first, second, third and fourth selector valves, each of said selector valves being connected to the discharge port of said seawater pump;

first, second, third and fourth jet feed pipes, said first jet feed pipe having one end thereof connected to said first selector valve, said second jet feed pipe having one end thereof connected to said second selector valve, said third jet feed pipe having one end thereof connected to said third selector valve and said fourth jet feed pipe having one end thereof connected to said fourth selector valve; and first, second, third and fourth direction steering nozzles mounted on the outer surface of said spherical charge element, said first direction steering nozzle being connected to an opposite end of said first jet feed pipe, said second direction steering nozzle being connected to an opposite end of said second jet feed pipe, said third direction steering nozzle being connected to an opposite end of said third jet feed pipe and said fourth direction steering nozzle being connected to an opposite end of said fourth jet feed pipe.

13. The weapon of claim 12 wherein said plurality of spherical charge elements comprises at least eight spherical charge elements.

14. The weapon of claim 12 wherein said predetermined radius said plurality of spherical charge elements are deployed from said torpedo is within a range of about ten feet to about thirty feet.

15. The weapon of claim 12 wherein said predetermined distance said torpedo travels from said position where said spherical charge elements are detonated is within a range of about five feet to about thirty feet.

16. The weapon of claim 12 wherein said first and third direction steering nozzles are two direction steering nozzles.

17. The weapon of claim 12 wherein said second and fourth direction steering nozzles are four direction steering nozzles.

18. The weapon of claim 12 wherein said propulsion system for each of said spherical charge elements further comprises:

a positional and navigation control computer having an output port connected to said first, second, third and fourth selector valves and said first, second, third and fourth direction steering nozzles, said positional and navigation control computer having a first input port connected to an output port of said slave sonar transceiver, a second input port, a third input port and a fourth input port;

a compass having an output port connected to the second input port of said positional and navigation control computer;

a vertical sensor having an output port connected to the third input port of said positional and navigation control computer; and a pressure sensor having an output port connected to the fourth input port of said positional and navigation control computer.

19. The weapon of claim 12 wherein said command signal generating circuit comprises:

an aiming circuit having an output port;

a positional navigation and control computer having an input port connected to the output port of said aiming circuit and an output port;

a necklace charge positioner computer having an input port connected to the output port of said positional navigation and control computer, a first output port connected to said command sonar transceiver and a second output port;

a detonation timing circuit having an input port connected to the second output port of said necklace charge positioner computer, a first output port connected to said main charge detonation circuit and a second output port; and a detonation command signal generator having an input port connected to the second output port of said detonation timing circuit and an output port connected to a second input port of said command sonar transceiver.

20. The weapon of claim 19 wherein said command signal generating circuit further comprises:

a target coordinates circuit having an output port connected to a first input port of said aiming circuit;

a compass having an output port connected to a second input port of said aiming circuit;

a vertical sensor having an output port connected to a third input port of said aiming circuit; and a pressure sensor having an output port connected to a fourth input port of said aiming circuit.

* * * * *